US007990357B2

(12) United States Patent
Shin

(10) Patent No.: US 7,990,357 B2
(45) Date of Patent: Aug. 2, 2011

(54) LIQUID CRYSTAL DISPLAY CONTROLLING A PERIOD OF A SOURCE OUTPUT ENABLE SIGNAL DIFFERENTLY AND DRIVING METHOD THEREOF

(75) Inventor: Jung Wook Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 789 days.

(21) Appl. No.: 11/452,382

(22) Filed: Jun. 14, 2006

(65) Prior Publication Data

US 2007/0097057 A1 May 3, 2007

(30) Foreign Application Priority Data

Oct. 31, 2005 (KR) ..... 10-2005-0103150

(51) Int. Cl.
*G09G 3/36* (2006.01)

(52) U.S. Cl. ..... 345/99; 345/96

(58) Field of Classification Search ..... 345/87–107
See application file for complete search history.

(56) References Cited

U.S. PATENT DOCUMENTS

| | | | | |
|---|---|---|---|---|
| 5,151,689 | A * | 9/1992 | Kabuto et al. | 345/103 |
| 6,329,975 | B1 * | 12/2001 | Yamaguchi | 345/99 |
| 6,618,032 | B1 * | 9/2003 | Seino | 345/99 |
| 6,842,161 | B2 * | 1/2005 | Song et al. | 345/96 |
| 7,193,599 | B2 * | 3/2007 | Kim et al. | 345/98 |
| 7,342,567 | B2 * | 3/2008 | Park | 345/100 |
| 7,385,576 | B2 * | 6/2008 | Moon | 345/87 |
| 2002/0024482 | A1 * | 2/2002 | Song et al. | 345/96 |
| 2002/0190937 | A1 * | 12/2002 | Song | 345/87 |
| 2004/0095308 | A1 * | 5/2004 | Kim et al. | 345/99 |
| 2004/0239602 | A1 * | 12/2004 | Kim et al. | 345/87 |
| 2004/0257322 | A1 * | 12/2004 | Moon | 345/87 |
| 2004/0263448 | A1 * | 12/2004 | Baek et al. | 345/87 |
| 2004/0263454 | A1 * | 12/2004 | Baek et al. | 345/87 |
| 2005/0030272 | A1 * | 2/2005 | Hosaka | 345/92 |
| 2006/0092120 | A1 * | 5/2006 | Nose | 345/98 |

FOREIGN PATENT DOCUMENTS

KR 10-2001-26596 * 4/2001

* cited by examiner

*Primary Examiner* — Chanh Nguyen
*Assistant Examiner* — Adam J Snyder
(74) *Attorney, Agent, or Firm* — McKenna Long & Aldridge LLP

(57) ABSTRACT

A liquid crystal display and a driving method for preventing a phenomenon causing a non-uniform charge characteristic between liquid crystal cells are disclosed. The liquid crystal display includes a picture display part having a plurality of gate lines and a plurality of data lines and having liquid crystal cells sharing a data line. A gate driver sequentially supplies a scanning pulse to the gate lines. A source output enable signal generator alternately generates a first source output enable signal having a first horizontal period and a second source output enable signal delayed from the first source output enable signal by a time longer than a half of the first horizontal period and shorter than the first horizontal period. A data driver supplies data voltages to the data lines in response to the first and second source output enable signals.

7 Claims, 7 Drawing Sheets

LIQUID CRYSTAL DISPLAY CONTROLLING A PERIOD OF A SOURCE OUTPUT ENABLE SIGNAL DIFFERENTLY AND DRIVING METHOD THEREOF

This application claims the benefit of Korean Patent Application No. 2005-0103150 filed in Korea on Oct. 31, 2005 which is hereby incorporated by reference for all purposes as if fully set forth herein.

BACKGROUND OF THE INVENTION

1. Field of the Invention

This invention relates to a liquid crystal display, and more particularly to a liquid crystal display and a driving method that is adaptive for preventing a phenomenon causing a non-uniform charge characteristic between liquid crystal cells.

2. Description of the Related Art

A typical liquid crystal display (LCD) controls light transmittance of a liquid crystal having a dielectric anisotropy property using an electric field to thereby display a picture. To this end, the LCD includes a liquid crystal display panel having liquid crystal cells arranged in a matrix type, and a driver for driving the liquid crystal display panel.

In the liquid crystal display panel, gate lines and data lines cross each other and liquid crystal cells are positioned at pixel areas defined by the crossings between the gate lines and the data lines. A pixel electrode and a common electrode are provided in each liquid crystal cell for applying an electric field to the liquid crystal cells. Each pixel electrode is connected to one of the data lines via source and drain terminals of a thin film transistor (TFT) provided as a switching device in each liquid crystal cell. A gate terminal of the TFT is connected to one of the gate lines. The gate lines are supplied with a scanning pulse.

The driver includes a gate driver for applying a scanning pulse or gate pulse to the gate lines; a data driver for converting a digital video data into an analog data voltage to supply it to the data lines; a timing controller for controlling the gate driver and the data driver; and a power supply for supplying various driving voltages used for the liquid crystal display device. The timing controller controls driving timing of the gate driver and the data driver, and supplies a digital video data to the data driver. The power supply uses a DC-DC converter to generate driving voltages to be supplied to the liquid crystal display panel including a common voltage Vcom, a gate high voltage VGH, and a gate low voltage VGL.

As liquid crystal display devices have trended towards large screens and high resolutions, the number of data lines and the number of gate lines of the liquid crystal display devices have increased. However, the liquid crystal display device has a problem in that, when the number of gate lines and data lines is increased, the number of data drivers and gate drivers is also increased accordingly.

In order to reduce the number of data drivers, liquid crystal display panels have been proposed in which adjacent liquid crystal cells can share a single data line to thereby reduce the number of data lines by half. FIG. 1 schematically illustrates a liquid crystal display panel having shared data lines, and FIG. 2 is a waveform diagram showing driving signals in the liquid crystal display panel shown in FIG. 1.

Referring to FIG. 1, the liquid crystal display panel of the related art having a shared data line structure includes liquid crystal cells 10 and 20 independently selected by different scanning pulses supplied from different gate lines GL1 to GLn to make a time divisional charge of data to the liquid crystal cells 10 and 20 from a single one of the data lines DL1 to DLm.

The first liquid crystal cells 10 arranged at the odd column each includes a first TFT 14 connected to one of the odd gate lines GL1, GL3 . . . GLn−1 and to the left side of one of the data lines DL1 to DLm, and a first pixel electrode 12 at the odd column connected to the first TFT 14. A source electrode of the first TFT 14 is connected to the left side of the data line DL while a drain electrode thereof is connected to the first pixel electrode 12. Further, a gate electrode of the TFT 14 is connected to odd gate lines GL1, GL3 . . . GLn−1.

The second liquid crystal cells 20 arranged at the even column each includes a second TFT 24 connected to one of the even gate lines GL2, GL4 . . . GLn and to the right side of one of the data lines DL1 to DLm, and a second pixel electrode 22 at the even column connected to the second TFT 24. A source electrode of the second TFT 24 is connected to the right side of the data line DL while a drain electrode thereof is connected to the second pixel electrode 22. Further, a gate electrode of the second TFT 24 is connected to the even gate lines GL2, GL4 . . . GLn.

Odd gate pulses for maintaining a high logic value TFT-on voltage during one horizontal period are sequentially applied to the odd gate lines GL1, GL3 . . . GLn−1 by means of the first gate driver. Even gate pulses for maintaining a high logic value TFT-on voltage during one horizontal period are sequentially applied to the even gate lines GL2, GL4 . . . GLn by means of the second gate driver. No period of overlap exists between the odd gate pulses and between the even gate pulses, whereas an overlapped period corresponding to ½ horizontal period exists between adjacent odd gate pulses and even gate pulses.

When a data voltage is supplied to the liquid crystal display panel as shown in FIG. 1 using a line inversion system, then charge characteristics between odd horizontal lines and even horizontal lines become different as shown in FIG. 2. The data driver has a line inversion system to invert the polarity of data for each horizontal line to supply them to the liquid crystal cells. In FIG. 1 and FIG. 2, 'RO', 'BO' and 'GE' represent red, green and blue liquid crystal cells at the odd column, and 'GO', 'RE' and 'BE' represent red, green and blue liquid crystal cells at the even column. Further, 'SOE' represents a source output enable signal for instructing a data output of the data driver. The data driver supplies a data voltage to the data lines DL1 to DLm during an interval between a falling edge and a rising edge of the SOE signal.

An operation of the liquid crystal display panel shown in FIG. 1 will be described below in which a negative data voltage is charged into the liquid crystal cells arranged at the odd horizontal lines while a positive data voltage is charged into the liquid crystal cells arranged at the even horizontal lines during an odd or even frame interval.

Referring to FIG. 1 and FIG. 2, first and second gate pulses which are overlapped for ½ horizontal period are sequentially applied to the first and second gate lines GL1 and GL2 for the purpose of charging a negative data into the liquid crystal cells included in the odd horizontal lines. The liquid crystal cells RO, BO and GE at the odd column included in the first horizontal line pre-charges a positive voltage by the last data voltage at the previous frame interval during the first half period of the first gate pulse, and thereafter charges negative data voltages −RO, −BO and −GE to be displayed during a P1 interval corresponding to the second half period of the first gate pulse and the first half period of the second gate pulse. During the P1 interval, the liquid crystal cells GO, RE and BE at the even column included in the first horizontal line pre-charge negative data voltages −RO, −BO and −GE. The liquid crystal cells GO, RE and BE at the even column included in the first horizontal line in which the negative voltage has been pre-charged during the P1 interval in this manner, charges negative data voltages −GO, −RE and −BE to be displayed during a P2 interval corresponding to the second half period of the second gate pulse.

Subsequently, third and fourth gate pulses, which are overlapped for ½ horizontal period are sequentially applied to the third and fourth gate lines GL3 and GL4 for the purpose of charging a positive data into the liquid crystal cells included in the even horizontal lines. The liquid crystal cells RO, BO and GE at the odd column included in the second horizontal line pre-charge negative voltages −GO, −RE and −BE during the P2 interval corresponding to the second half period of the second gate pulse and the first half period of the third gate pulse, and thereafter charges positive data voltages +RO, +BO and +GE during a P3 interval corresponding to the second half period of the third gate pulse. During the P3 interval, the liquid crystal cells GO, RE and BE at the even column included in the second horizontal line pre-charge positive data voltages +RO, +BO and +GE. The liquid crystal cells GO, RE and BE at the even column included in the second horizontal line in which a positive voltage has been pre-charged during the P3 interval in this manner, charge positive data voltages +GO, +RE and +BE to be displayed during a P4 interval corresponding to the second half period of the fourth gate pulse.

As a result, since the liquid crystal cells at the odd column and the liquid crystal cells at the even column in the liquid crystal display device as shown in FIG. 1 and FIG. 2 share the same data line, the liquid crystal display panel makes a time divisional application of a data voltage supplied via the same data line to the liquid crystal cells at the odd column and the liquid crystal cells at the even column, and pre-charges the liquid crystal cells at the next horizontal line into a data voltage at the previous horizontal line in order to heighten a charge speed of the liquid crystal cells.

In the liquid crystal display device as shown in FIG. 1 and FIG. 2, the liquid crystal cells at the odd column pre-charge positive voltages (or negative voltages) by the odd gate pulses and thereafter charge negative data voltages (or positive data voltages) to be displayed; whereas the liquid crystal cells at the even column pre-charge negative voltages (or positive voltages) by the even gate pulses and thereafter charge negative data voltages (or positive data voltages) to be displayed. In other words, the liquid crystal cells at the odd column charge a data voltage having a polarity different from the pre-charged voltage, whereas the liquid crystal cells at the even column charge a data voltage having the same polarity as the pre-charged voltage. Therefore, even when the liquid crystal display device shown in FIG. 1 and FIG. 2 supplies voltages having the same gray level to the liquid crystal cells at the odd column and the liquid crystal cells at the even column, a vertical stripe is generated on the display because voltages charged in the liquid crystal cells at the even column are relatively larger than voltages charged in the liquid crystal cells at the odd column.

SUMMARY OF THE INVENTION

Accordingly, the present invention is directed to a liquid crystal display and driving method thereof that substantially obviates one or more of the problems due to limitations and disadvantages of the related art.

An advantage of the present invention is to provide a liquid crystal display and a driving method thereof that is adaptive for preventing a phenomenon of causing a non-uniform charge characteristic between liquid crystal cells when a data is supplied to a liquid crystal display panel in which adjacent liquid crystal cells share the same data line by a line inversion system.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a picture display part having a plurality of gate lines and a plurality of data lines and provided with liquid crystal cells having a shared data line; a gate driver to sequentially supply a scanning pulse to the gate lines; a source output enable signal generator to alternately generate a first source output enable signal having a first horizontal period and a second source output enable signal delayed from the first source output enable signal by a time (D1) longer than a half of the first horizontal period and shorter than the first horizontal period; and a data driver to supply data voltages to the data lines in response to the first and second source output enable signals.

In another aspect of the present invention, in the liquid crystal display device, the liquid crystal cells include first liquid crystal cells at the odd column arranged at the left side of the data line to continuously charge a different polarity of data voltages; and second liquid crystal cells at the even column arranged at the right side of the data line to continuously charge data voltages having the same polarity.

In another aspect of the present invention, a method of driving a liquid crystal display device, including a picture display part having a plurality of gate lines and a plurality of data lines and provided with liquid crystal cells having a shared data line, includes alternately generating a first source output enable signal having a first horizontal period and a second source output enable signal delayed from the first source output enable signal by a time (D1) longer than a half of the first horizontal period and shorter than the first horizontal period; sequentially supplying a scanning pulse to the gate lines; and supplying data voltages to the data lines in response to the first and second source output enable signals.

In another aspect of the present invention, a liquid crystal display device includes a picture display part having a plurality of gate lines and a plurality of data lines and provided with liquid crystal cells sharing the same data line; a gate driver for sequentially supplying a scanning pulse to the gate lines; a source output enable signal generator for alternately generating a first source output enable signal having a first horizontal period and a second source output enable signal delayed from the first source output enable signal; and a data driver for supplying data voltages to liquid crystal cells connected to one side and other side of the data lines during a different time in response to the first and second source output enable signals.

In another aspect of the present invention a liquid crystal display device includes a picture display part having a plurality of gate lines and a plurality of data lines and provided with liquid crystal cells sharing the same data line; a gate driver for sequentially supplying a scanning pulse to the gate lines; a source output enable signal generator for alternately generating a first source output enable signal having a first period and a second source output enable signal having a second period shorter than the first period; and a data driver for supplying data voltages to the data lines in response to the source output enable signals having the first and second periods.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
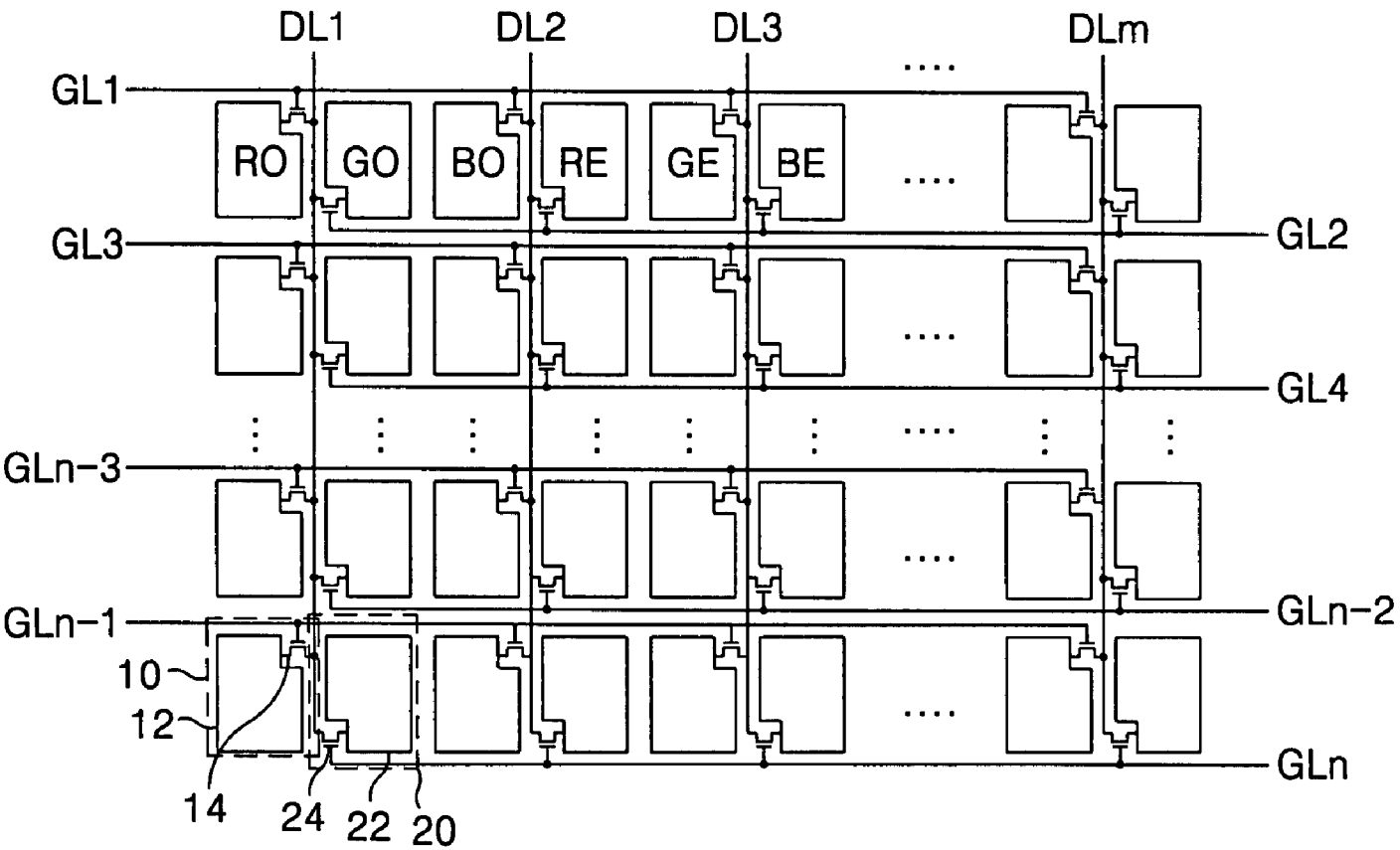
FIG. 1 RELATED ART
FIG. 1 is a schematic plan view showing a structure of a related art liquid crystal display panel.
Figure 2:
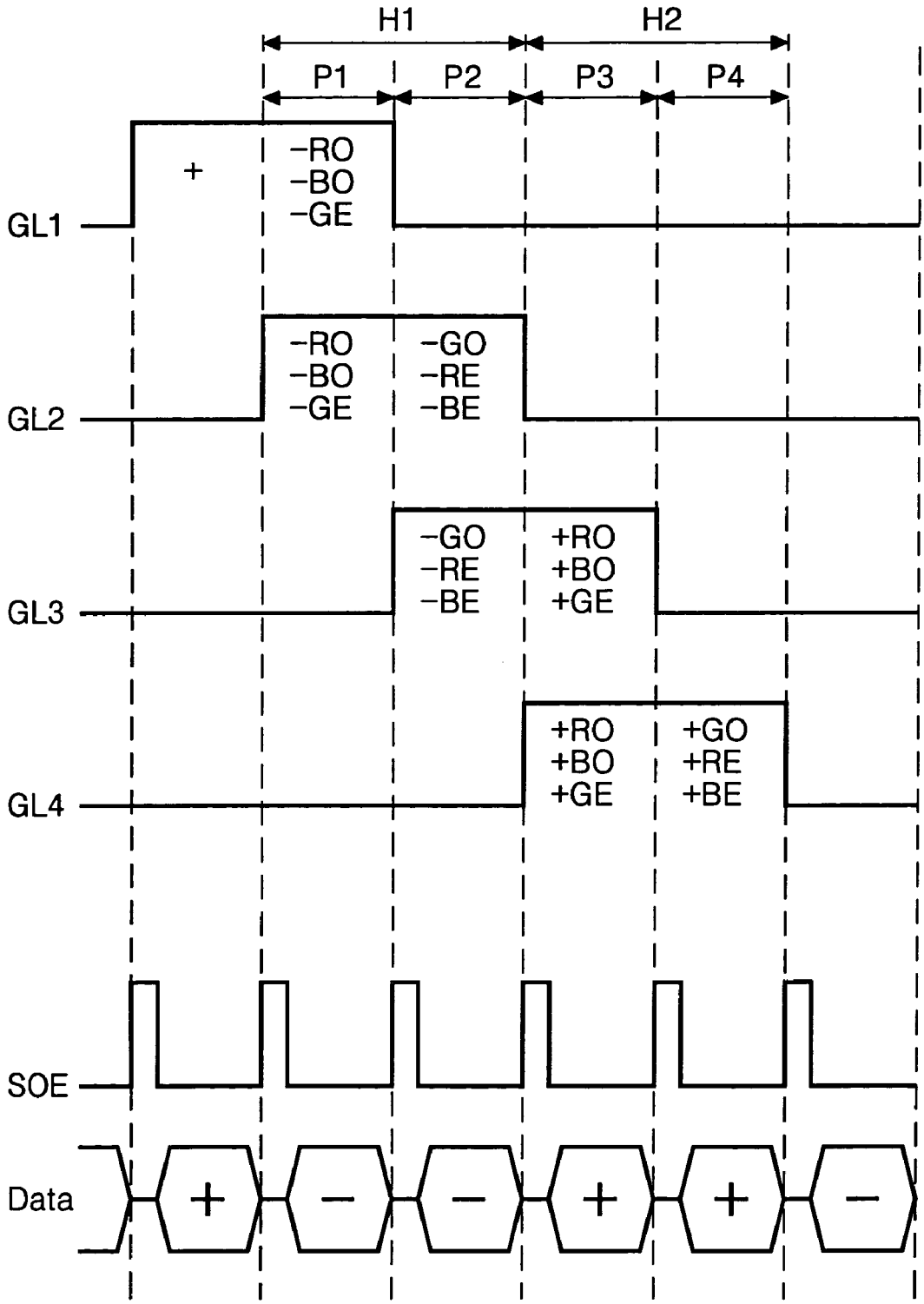
FIG. 2 RELATED ART
FIG. 2 is a waveform diagram showing the driving signals for the liquid crystal display panel shown in FIG. 1.
Figure 3:
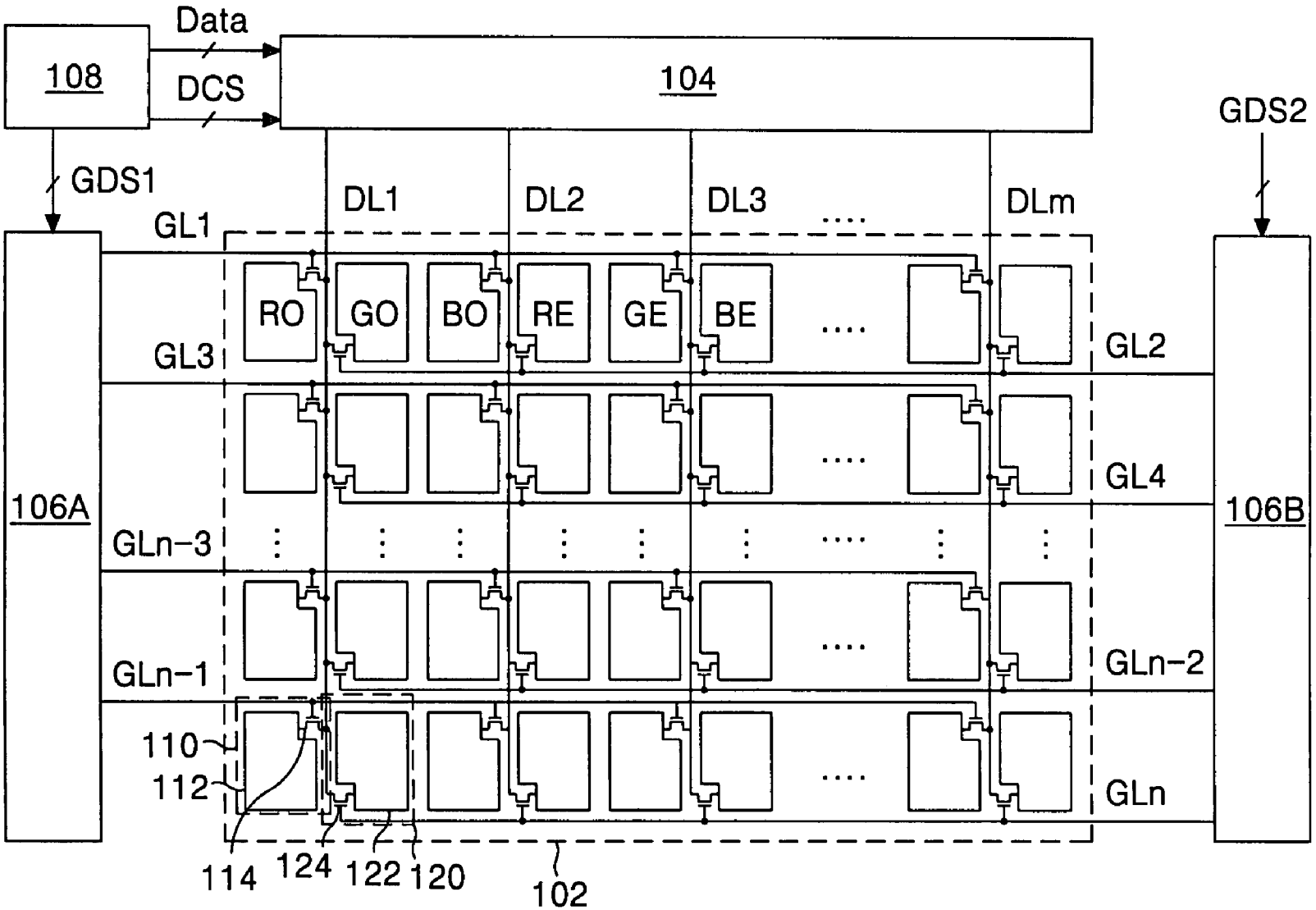
FIG. 3 is a schematic view showing a configuration of a driving apparatus for a liquid crystal display device according to an embodiment of the present invention.

FIG. 3 schematically illustrates a configuration of a driving apparatus for a liquid crystal display device according to an embodiment of the present invention.

Referring to FIG. 3, the liquid crystal display device includes a picture display part 102 having a plurality of gate lines GL1 to GLn and a plurality of data lines DL1 to DLm; a plurality of liquid crystal cells 110 and 120 sharing a data line DL; first and second gate drivers 106A and 106B for sequentially applying a scanning pulse to the gate lines GL1 to GLn; a data driver 104 for supplying a video data to the liquid crystal cells 110 and 120 by a line inversion system; and a timing controller 108 for controlling the gate drivers 106A and 106B and the data driver 104.

The first plurality of liquid crystal cells 110 are arranged at the odd column and each includes a first TFT 114 connected to odd gate lines GL1, GL3 . . . GLn−1 and to left side of one of the data lines DL1 to DLm, and a first pixel electrode 112 at the odd column connected to the first TFT 114. A source electrode of the first TFT 114 is connected to the left side of the data lines DL1 to DLm while a drain electrode thereof is connected to the first pixel electrode 112. Further, a gate electrode of the TFT 114 is connected to odd gate lines GL1, GL3 . . . GLn−1.

The plurality of second liquid crystal cells 120 are arranged at the even column and each includes a second TFT 124 connected to even gate lines GL2, GL4 . . . GLn and to the right side of one of the data lines DL1 to DLm, and a second pixel electrode 122 at the even column connected to the second TFT 124. A source electrode of the second TFT 124 is connected to the right side of the data lines DL1 to DLm while a drain electrode thereof is connected to the second pixel electrode 122. Further, a gate electrode of the second TFT 124 is connected to the even gate lines GL2, GL4 . . . GLn.

Odd gate pulses for maintaining a high logic value TFT-on voltage during one horizontal period are sequentially applied to the odd gate lines GL1, GL3 . . . GLn−1 by means of the first gate driver 106A. On the other hand, even gate pulse for maintaining a high logic value TFT-on voltage during one horizontal period are sequentially applied to the even gate lines GL2, GL4, . . . , GLn by means of the second gate driver 160B. No period of overlap exists between the odd gate pulses or between the even gate pulses, whereas an overlapped period corresponding to ½ horizontal period exists between adjacent odd gate pulses and even gate pulses.

The timing controller 108 supplies digital video data supplied from the exterior thereof to the data driver 104. Further, the timing controller 108 generates gate control signals GDS1 and GDS2, including a gate start pulse GSP; a plurality of gate shift clocks GSC and a gate output enable signal GOE for controlling driving timing of the gate drivers 106A and 106B using a data enable signal DE; a horizontal synchronizing signal Hsync, a vertical synchronizing signal Vsync; and a dot clock DCLK from an external system. Herein, gate start pulses GSP supplied to the first and second gate drivers 106A and 106B have a phase difference such that gate pulses generated from the first and second gate drivers 106A and 106B are superposed with respect to each other.

Moreover, the timing controller 108 generates data control signals DCS, including a source start pulse SSP; a source shift clock SSC; a polarity control signal POL and a source output enable signal SOE_NEW for controlling a driving timing of the data driver 104 using the data enable signal DE; the horizontal synchronizing signal Hsync; the vertical synchronizing signal Vsync; and the dot clock DCLK, and supplies the data control signals DCS to the data driver 104. The data driver 104 inverts the polarity of a data voltage for each horizontal line in response to the polarity control signal POL, and differently controls a pre-charging time of the liquid crystal cells at the odd column and a pre-charging time of the liquid crystal cells at the even column in response to the source output enable signal SOE_NEW.

The first gate driver 106A generates a scanning pulse in response to a first gate control signal GDS1 supplied from the timing controller 108, and sequentially supplies the scanning pulse to the odd gate lines GL1, GL3 . . . GLn−1.

The second gate driver 106B generates a scanning pulse in response to a second gate control signal GDS2 from the timing controller 104, and sequentially supplies the scanning pulse to the even gate lines GL2, GL4, . . . , GLn.

The first and second gate drivers 106A and 106B may be formed along with a picture display part 102 on a substrate provided with the picture display part 102, or may be formed on a separate substrate.

The data driver 104 converts digital video data Data supplied from the timing controller 108 into an analog gamma compensating voltage in response to the data control signal DCS from the timing controller 108 to generate an analog video voltage, and inverts the polarity of the analog video voltage by line inversion system in response to the polarity control signal POL and thereafter supplies the polarity inverted analog video voltage to the data lines DL1 to DLm in response to the source output enable signal SOE_NEW.

Figure 4:
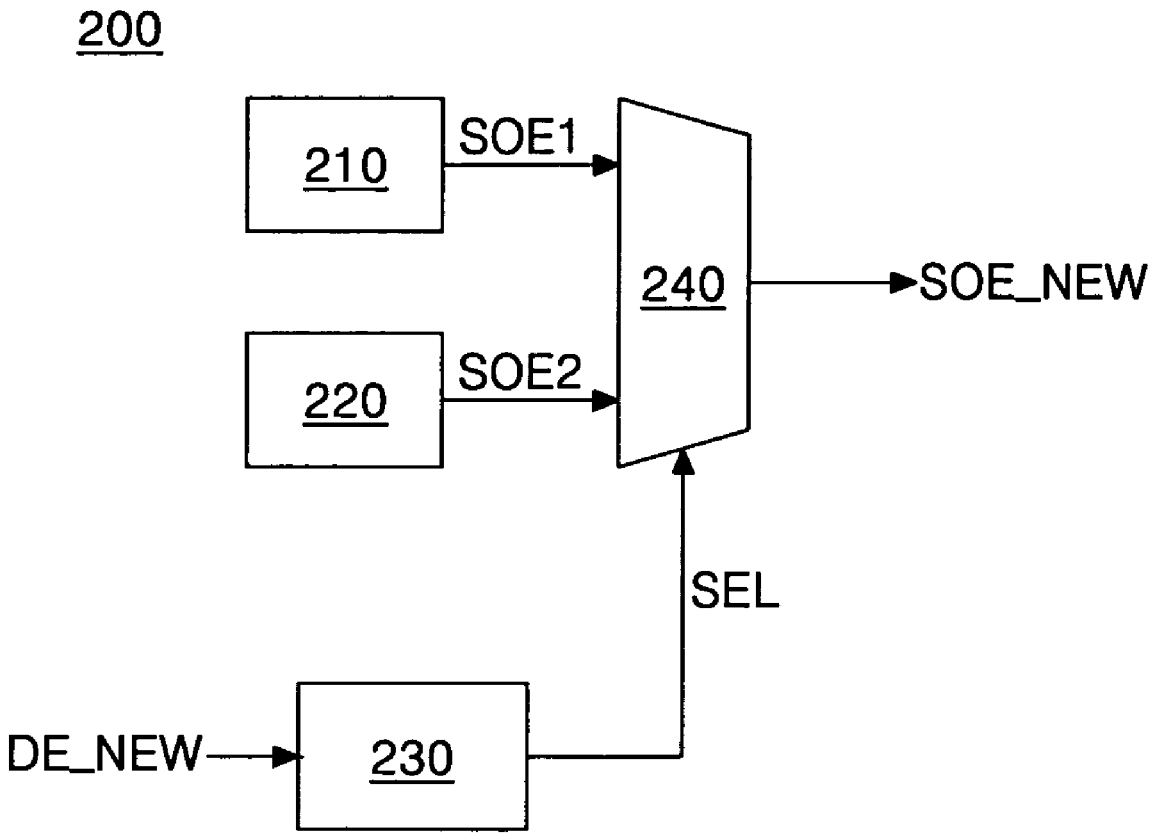
FIG. 4 is a schematic block diagram of the source output enable signal generator shown in FIG. 3.
Figure 5:
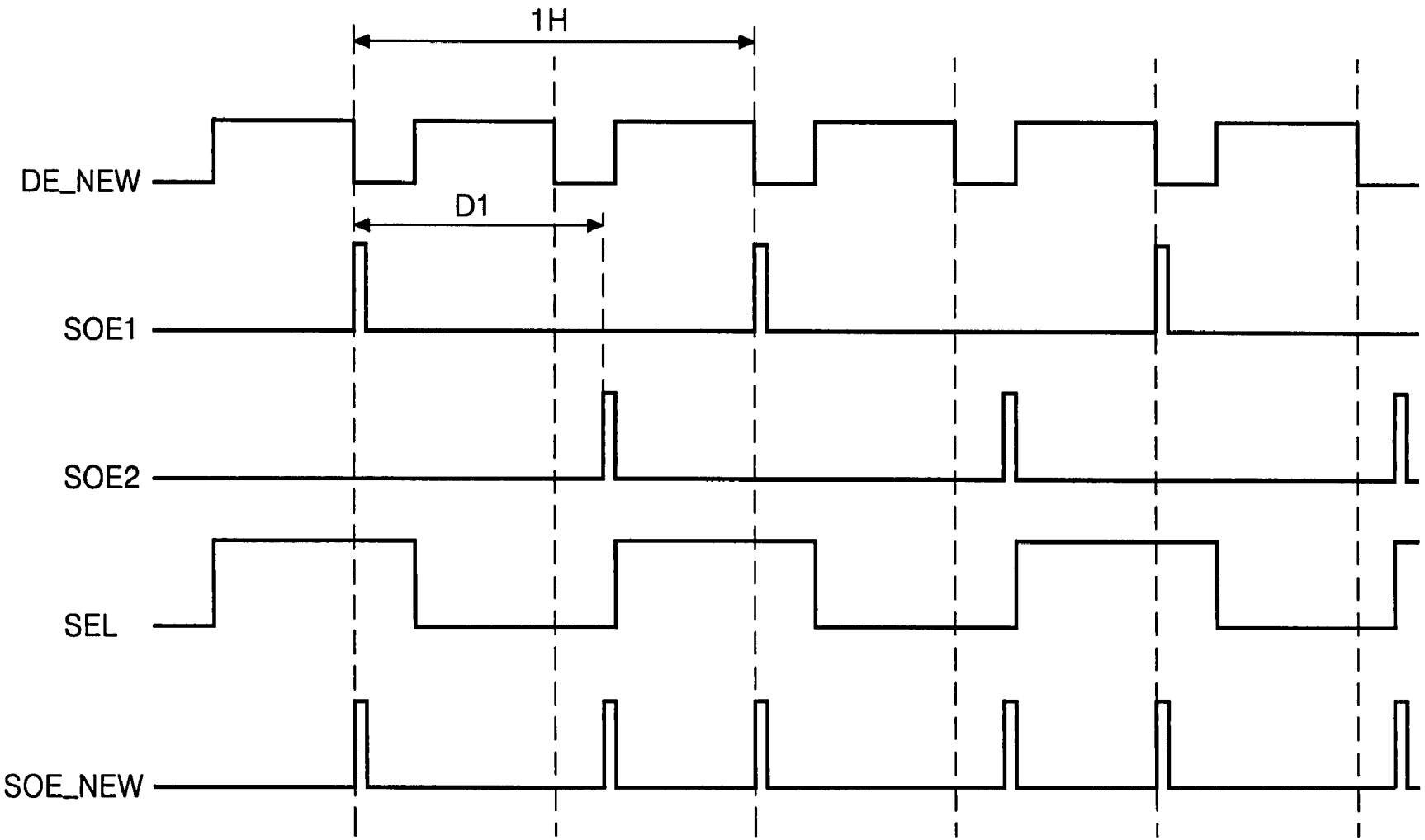
FIG. 5 is a waveform diagram showing the input/output signals of the source output enable signal generator shown in FIG. 4.

FIG. 4 shows the source output enable signal generator 200 of the timing controller 108, and FIG. 5 shows input/output waveforms of the source output enable signal generator 200.

Referring to FIG. 4 and FIG. 5, the source output enable signal generator 200 includes a first source output enable signal generator 210, a second source output enable signal generator 220, a selecting signal generator 230, and a selecting part 240.

The first source output enable signal generator 210 generates a first output enable signal SOE1 for selecting the output time of a pre-charged voltage to be supplied to the first liquid crystal cells 110 at the odd column and a data voltage to be supplied to the second liquid crystal cells 120 at the even column.

The second source output enable signal generator 220 generates a second output enable signal SOE2 for selecting the output time of a pre-charged voltage to be supplied to the second liquid crystal cells 120 at the even column and a data voltage to be supplied to the first liquid crystal cells 110 at the odd column.

Each of the first and second source output enable signals SOE1 and SOE2 is generated in one horizontal period 1H. The second source output enable signal SOE2 is delayed from the first source output enable signal SOE1 by a time D1 longer than ½ horizontal period and shorter than 1 horizontal period. The relative timing between the first and second source output enable signals SOE1 and SOE2 can be freely adjusted using circuits specified or synthesized using means such as Verilog HDL or VHDL.

Figure 6:
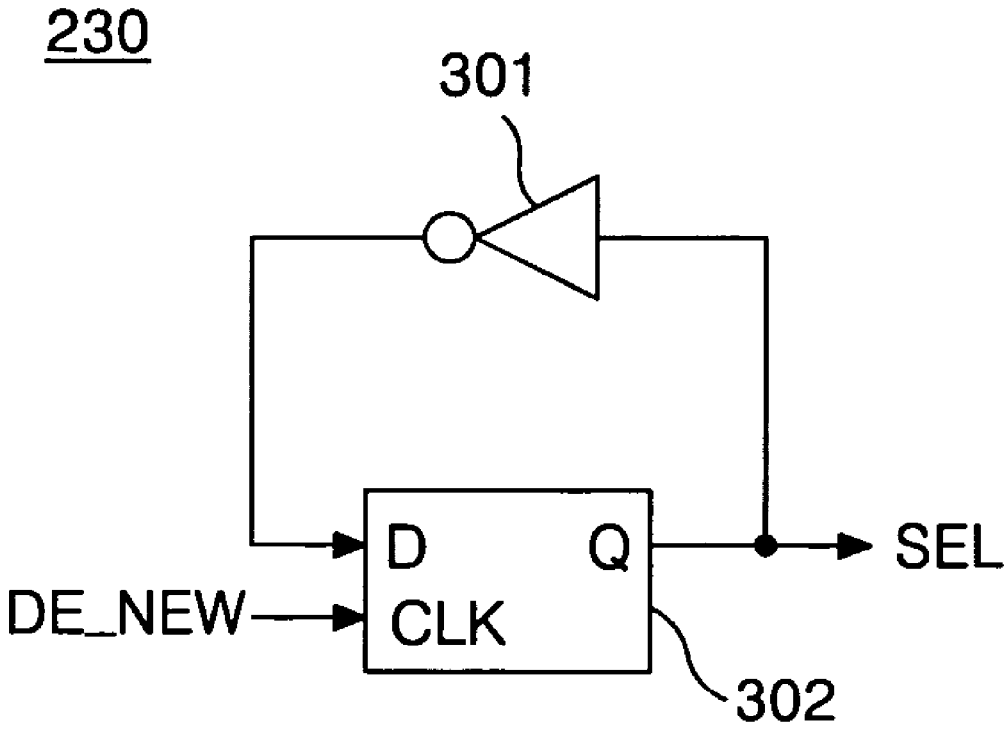
FIG. 6 is a circuit diagram of an implementation of the selecting signal generator shown in FIG. 4.

The selecting signal generator 230 receives a second data enable signal DE_NEW and inverts the second data enable signal DE_NEW at the rising edge of the second data enable signal DE_NEW to thereby generate a selecting signal SEL. The second data enable signal DE_NEW has twice the frequency of the data enable signal DE supplied from the external system. As shown in FIG. 6, the selecting signal generator 230 can be implemented by a D flip-flop 302 having a clock terminal CLK to which the second data enable signal DE_NEW is inputted and a D terminal to which the inverted selecting signal SEL is inputted, and an inverter 301 for inverting the selecting signal SEL.

The selecting part 240 outputs a source output enable signal SOE_NEW by selecting the first output enable signal SOE1 and the second output enable signal SOE2 alternately using the selecting signal SEL.

The liquid crystal display device according to the illustrated embodiment of the present invention supplies a data to the liquid crystal display panel by the line inversion system in which negative data voltages are applied to the liquid crystal cells arranged at the odd horizontal lines while positive data voltages are applied to the liquid crystal cells arranged at the even horizontal lines, and inverts the polarity of the data for each frame. An operation of such a liquid crystal display device will be described in detail in conjunction with FIG. 3 and FIG. 7 below.

Figure 7:
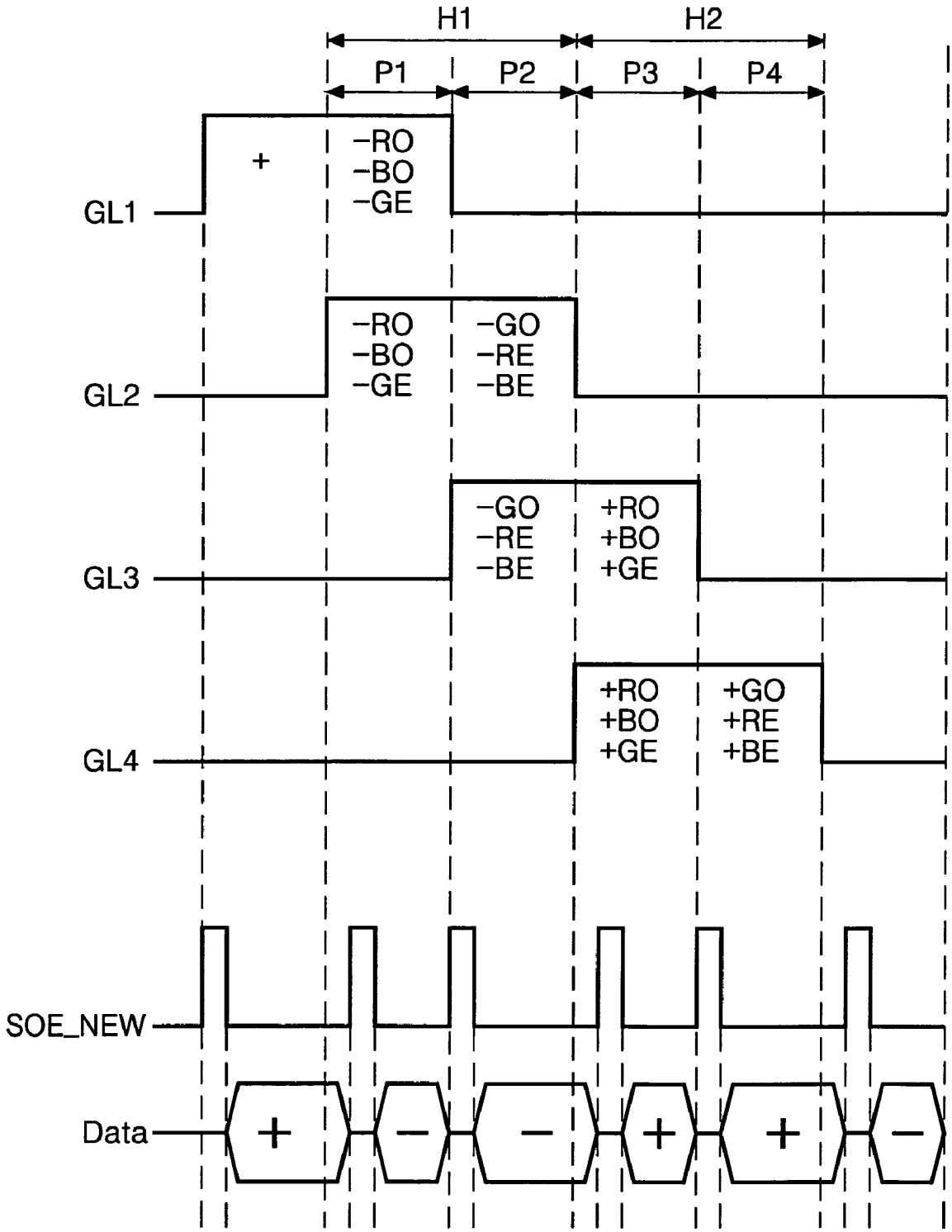
FIG. 7 is a waveform diagram illustrating a method of driving the liquid crystal display device according to an embodiment of the present invention.

Referring to FIG. 3 and FIG. 7, first and second gate pulses overlapped during ½ horizontal period are sequentially applied to the first and second gate lines GL1 and GL2 for the purpose of charging a negative data into the liquid crystal cells included in the odd horizontal lines. The liquid crystal cells RO, BO and GE at the odd column included in the first horizontal line pre-charges a positive voltage by the last data voltage at the previous frame interval during the first half period of the first gate pulse, and thereafter charges negative data voltages −RO, −BO and −GE to be displayed during a P1 interval corresponding to the second half period of the first gate pulse and the first half period of the second gate pulse. Herein, the data driver 104 outputs negative data voltages −RO, −BO and −GE from a time later than the ½ horizontal period at which the P1 period is started in response to the source output enable signal SOE_NEW.

During the P1 interval, the liquid crystal cells GO, RE and BE at the even column included in the first horizontal line pre-charge negative data voltages −RO, −BO and −GE from the falling edge of the source output enable signal SOE_NEW generated relatively late within the P1 interval, and thereafter charge negative data voltages −GO, −RE and −BE to be displayed from the falling edge of the source output enable signal SOE_NEW generated simultaneously at an initiation of the P2 interval corresponding to the second half of the second gate pulse.

Subsequently, third and fourth gate pulses overlapped during ½ horizontal period are sequentially applied to the third and fourth gate lines GL3 and GL4 for the purpose of charging a positive data into the liquid crystal cells included in the even horizontal lines. The liquid crystal cells RO, BO and GE at the odd column included in the second horizontal line pre-charge negative voltages −GO, −RE and −BE during the P2 interval corresponding to the second half period of the second gate pulse and the first half period of the third gate pulse, and thereafter charges positive data voltages +RO, +BO and +GE during a P3 interval corresponding to the second half period of the third gate pulse. Herein, the data driver 104 outputs positive data voltages +RO, +BO and +GE from a time later than the ½ horizontal period at which the P3 interval is started in response to the source output enable signal SOE_NEW generated relatively late within the P3 interval. The liquid crystal cells GO, RE and BE at the even column included in the second horizontal line pre-charge positive data voltages +RO, +BO and +GE from the falling edge of the source output enable signal SOE_NEW generated relatively late within the P3 interval, and thereafter charge the positive data voltages +GO, +RE and +BE to be displayed during a P4 period corresponding to the second half of the fourth gate pulse.

As a result, the liquid crystal display device according to the embodiment of the present invention makes a periodically different control of a period of the source output enable signal SOE_NEW, thereby allowing a pre-charging time of the liquid crystal cells in which the polarity of the pre-charged voltage is identical to that of the data voltage to be shorter than a pre-charging time of the liquid crystal cells in which the polarity of the pre-charged voltage is different from that of the data voltage. The polarity based differences in pre-charging times compensate the polarity driven non-uniform charge characteristics of the liquid crystal cells.

As described above, according to the present invention, a period of the source output enable signal SOE_NEW can be periodically differently controlled, thereby allowing charge characteristics of the liquid crystal cells in which the polarity of the pre-charged voltage is identical to that of the data voltage and charge characteristics of the liquid crystal cells in which the polarity of the pre-charged voltage is different from that of the data voltage to be uniform with respect to each other.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display, including a picture display part having a plurality of gate lines and a plurality of data lines and provided with liquid crystal cells having a shared data line, comprising:

alternately generating a first source output enable signal having a first horizontal period and a second source output enable signal delayed from the first source output enable signal by a time (D1) longer than a half of the first horizontal period and shorter than the first horizontal period;

generating a new source output enable signal by selecting the first and second source enable signals alternately using a selecting signal;

sequentially supplying a scanning pulse to the gate lines;

supplying data voltages to the data lines in response to the new source output enable signal; and inverting the polarity of data voltages for each horizontal period, wherein the selecting signal is generated by receiving a second data enable signal and inverting the second data enable signal at the rising edge of the second data enable signal, wherein the second data enable signal has twice the frequency of a first data enable signal supplied from an external system, wherein the liquid crystal cells include first liquid crystal cells arranged in an odd column on the left side of the shared data line to continuously charge data voltages having alternating polarities and second liquid crystal cells at the even column arranged at the right side of the shared data line to continuously charge data voltages having the same polarity, wherein the first source output enable signal is generated for selecting a output time of a pre-charged voltage to be supplied to the first liquid crystal cells at the odd column and a data voltage to be supplied to the second liquid crystal cells at the even column, wherein the second source output enable signal is generated for selecting a output time of a pre-charged voltage to be supplied to the second liquid crystal cells at the even column and a data voltage to be supplied to the first liquid crystal cells at the odd column, wherein the new source output enable signal selectively outputs the first source output enable signal when the select signal is a high period, and selectively outputs the second source output enable signal when the select signal is a low period before rising edge time.

2. The method according to claim 1, wherein sequentially supplying a scanning pulse to the gate lines includes:

sequentially supplying a first scanning pulse to odd gate lines; and sequentially supplying a second scanning pulse to even gate lines, and wherein each of the first and second scanning pulses is to be generated during a horizontal period, and the second half period of the first scanning pulse is overlapped with the first half period of the second scanning pulse.

3. A liquid crystal display device, comprising:

a picture display part having a plurality of gate lines and a plurality of data lines and provided with liquid crystal cells having a shared data line;

a gate driver to sequentially supply a scanning pulse to the gate lines;

a source output enable signal generator to alternately generate a first source output enable signal having a first horizontal period and a second source output enable signal delayed from the first source output enable signal by a time (D1) longer than a half of the first horizontal period and shorter than the first horizontal period;

a selecting part to generate a new source output enable signal by selecting the first and second source enable signals alternately using a selecting signal;

a selecting signal generator to generate the selecting signal by receiving a second data enable signal and inverting the second data enable signal at the rising edge of the second data enable signal; and a data driver to supply data voltages to the data lines in response to the new source output enable signal, wherein the second data enable signal has twice the frequency of a first data enable signal supplied from an external system, wherein the selecting signal generator is implemented by a D flip-flop having a clock terminal to which the second data enable signal is inputted and a D terminal to which the inverted selecting signal is inputted, and an inverter for inverting the selecting signal, wherein the liquid crystal cells include first liquid crystal cells arranged in an odd column on the left side of the shared data line to continuously charge data voltages having alternating polarities and second liquid crystal cells arranged in an even column on the right side of the shared data line to continuously charge data voltages having the same polarity, wherein the first source output enable signal is generated for selecting a output time of a pre-charged voltage to be supplied to the first liquid crystal cells at the odd column and a data voltage to be supplied to the second liquid crystal cells at the even column, wherein the second source output enable signal is generated for selecting a output time of a pre-charged voltage to be supplied to the second liquid crystal cells at the even column and a data voltage to be supplied to the first liquid crystal cells at the odd column, wherein the new source enable signal selectively output the first source output enable signal when the select signal is a high period, and selectively outputs the second source output enable signal when the select signal is a low period before rising edge time.

4. The liquid crystal display device according to claim 3, wherein the gate driver includes:

a first gate driver to sequentially supply a first scanning pulse to odd gate lines; and a second gate driver to sequentially supply a second scanning pulse to even gate lines, and wherein each of the first and second scanning pulses is to be generated during a horizontal period, and the second half period of the first scanning pulse is overlapped with the first half period of the second scanning pulse.

5. The liquid crystal display device according to claim 3, wherein the data driver is arranged to invert the polarity of data voltages for each horizontal period.

6. A liquid crystal display device, comprising:

a picture display part having a plurality of gate lines and a plurality of data lines and provided with liquid crystal cells sharing the same data line;

a gate driver to sequentially supply scanning pulse to the gate lines;

a source output enable signal generator to alternately generate a first source output enable signal having a first horizontal period and a second source output enable signal delayed from the first source output enable signal;

a selecting part to generate a new source output enable signal by selecting the first and second source enable signals alternately using a selecting signal;

a selecting signal generator to generate the selecting signal by receiving a second data enable signal and inverting the second data enable signal at the rising edge of the second data enable signal; and a data driver to supply data voltages to liquid crystal cells connected to one side and other side of the data lines during a different time in response to the new source output enable signal, wherein the second data enable signal has twice the frequency of a first data enable signal supplied from an external system, wherein the selecting signal generator is implemented by a D flip-flop having a clock terminal to which the second data enable signal is inputted and a D terminal to which the inverted selecting signal is inputted, and an inverter for inverting the selecting signal, wherein the second source output enable signal is generated to be delayed from the first source output enable signal by a time (D1) longer than a half of the first horizontal period and shorter than the first horizontal period, wherein the liquid crystal cells connected to one side of the data line are arranged to be supplied with a data voltage during a longer time in comparison to the liquid crystal cells connected to other side thereof, wherein the new source enable signal selectively output the first source output enable signal when the select signal is a high period, and selectively outputs the second source output enable signal when the select signal is a low period before rising edge time.

7. A liquid crystal display device, comprising:

a picture display part having a plurality of gate lines and a plurality of data lines and provided with liquid crystal cells sharing the same data line;

a gate driver to sequentially supply a scanning pulse to the gate lines;

a source output enable signal generator to alternately generate a first source output enable signal having a first period and a second source output enable signal having a second period shorter than the first period;

a selecting part to generate a new source output enable signal by selecting the first and second source enable signals alternately using a selecting signal;

a selecting signal generator to generate the selecting signal by receiving a second data enable signal and inverting the second data enable signal at the rising edge of the second data enable signal; and a data driver to supply data voltages to the data lines in response to the first and second source output enable signals, wherein the second data enable signal has twice the frequency of a first data enable signal supplied from an external system, wherein the selecting signal generator is implemented by a D flip-flop having a clock terminal to which the second data enable signal is inputted and a D terminal to which the inverted selecting signal is inputted, and an inverter for inverting the selecting signal, wherein the new source enable signal selectively output the first source output enable signal when the select signal is a high period, and selectively outputs the second source output enable signal when the select signal is a low period before rising edge time.

* * * * *